US007345958B1

(12) United States Patent
Kneafsey

(10) Patent No.: US 7,345,958 B1
(45) Date of Patent: Mar. 18, 2008

(54) SWIMMING LAP COUNTER AND METHOD OF USE

(76) Inventor: Marilyn B. Kneafsey, 1100 Imperial Dr., #406, Sarasota, FL (US) 34236

( * ) Notice: Subject to any disclaimer, the term of this patent is extended or adjusted under 35 U.S.C. 154(b) by 0 days.

(21) Appl. No.: 11/605,910

(22) Filed: Nov. 29, 2006

(51) Int. Cl.
*G04F 8/00* (2006.01)

(52) U.S. Cl. ..... 368/107; 368/89

(58) Field of Classification Search ..... 368/89, 368/107, 108–109
See application file for complete search history.

(56) References Cited

U.S. PATENT DOCUMENTS 4,236,240 A * 11/1980 Yoshida ..... 368/76
4,337,529 A * 6/1982 Morokawa ..... 377/20
4,451,158 A * 5/1984 Selwyn et al. ..... 368/63
4,769,797 A * 9/1988 Murakami ..... 368/111
4,932,045 A * 6/1990 Kasoff et al. ..... 377/24.2
5,088,072 A 2/1992 Fitzmorris
5,125,010 A 6/1992 Lee et al.
5,136,621 A 8/1992 Mitchell et al.
5,404,385 A 4/1995 BenHaim
5,767,417 A 6/1998 Parris et al.
5,795,301 A * 8/1998 Yasukawa et al. ..... 600/500
6,009,138 A 12/1999 Slusky
6,125,081 A * 9/2000 Flynn ..... 368/10
6,795,375 B2 * 9/2004 Streja ..... 368/10
6,940,784 B1 9/2005 Benson

* cited by examiner

*Primary Examiner*—Renee Luebke
*Assistant Examiner*—Sean Kayes
(74) *Attorney, Agent, or Firm*—Charles J. Prescott

(57) ABSTRACT

A wrist worn lap counter and method of use for a swimmer including an electronic lap counter/timer module and a wrist strap connected to the module for attachment around the wrist of the swimmer. The module includes a water resistant housing having a viewable front face and a transparent lens covering a digital display, the digital display being operable to simultaneously display a lap set number, lap indicating number, and a current set elapsed time number. First and second input buttons are positioned on the housing, the first input button being operable to incrementally increase the lap set number and to zero and restart the elapsed time number, the second input button being operable to increment or reset to zero the lap indicating number. Pressing either button will activate the module while deactivation preferably requires pressing and holding both buttons.

4 Claims, 5 Drawing Sheets

SWIMMING LAP COUNTER AND METHOD OF USE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to sporting event lap counting and timing devices and more particularly to a wrist-worn set and lap counter and set timer for a swimmer doing swimming laps in a pool.

2. Description of Related Art

Lap counting and timing devices are well known for use by athletes and trainers in sports such as running and swimming. In competitions, it is important to know the number of laps completed and the time to complete such laps. It is also important for athletes to be able to compare statistics and rate their progress in personal training programs.

One such device is shown in U.S. Pat. No. 4,932,045 to Kasoff, et al. which discloses a waterproof digital lap counter attached to a hand or foot of a user. The device of Kasoff teaches the automatic counting and indication of laps traversed, triggered by abutment of the lap counter against the side of the swimming pool, momentarily closing a switch that sends an input signal to the visible LCD array. A similar sport counting and timing device is disclosed by Fitzmorris in U.S. Pat. No. 5,088,072. The device is made to be worn about one or more fingers of the user and is thumb actuated, providing information for both measuring and pacing performance.

Lee, et al. teaches a lap counting system with radio communication including transmitter and receiver in U.S. Pat. No. 5,125,010. By employing radio frequency, the lap counting system increments a lap count each time the distance between the receiver and the transmitter becomes smaller than the communication range. Mitchell, et al. discloses a timing and lap counting device for swimmers in U.S. Pat. No. 5,136,621 having a waterproof housing. An ultrasonic transmitter is worn by the swimmer and, each time the swimmer passes over the waterproof housing, the numbers are viewable in the water.

A swim meter to be worn by a swimmer that indicates speed, distance, time and other measurements is taught by Parris, et al. in U.S. Pat. No. 5,767,417. The primary object of the '417 device is to provide average swimming speed when the distance completed is of unknown size, i.e. lakes, oceans as well as providing current speed while swimming. A lap counting device utilizing GPS is disclosed in U.S. Pat. No. 6,009,138 to Slusky and a unit consisting of a lap counter and radio is taught by Ben-Haim in U.S. Pat. No. 5,404,385. A hand-held submergible lap counting display device is disclosed in U.S. Pat. No. 6,940,784 to Benson.

The wrist worn lap counter of the present invention is water resistant having a viewable digital display being operable to simultaneously display a lap number, a set number for a selected number of laps and a current set elapsed time number. The timer of the present invention will reset to zero each time the appropriate button is pressed.

BRIEF SUMMARY OF THE INVENTION

This invention is directed to a wrist worn lap counter and method of use for a swimmer including an electronic lap counter/timer module and a wrist strap connected to the module for attachment around the wrist of the swimmer. The module includes a water resistant housing having a viewable front face and a transparent lens covering a digital display, the digital display being operable to simultaneously display a lap set number, lap indicating number, and a current set elapsed time number. First and second input buttons are positioned on the housing, the first input button being operable to incrementally increase the lap set number and to zero and restart the elapsed time number, the second input button being operable to increment or reset the lap indicating number to zero. Pressing either button will activate the module while deactivation preferably requires pressing and holding both buttons.

It is therefore an object of this invention to provide a lap and set counter for swimmers which simultaneously monitors elapsed time per set.

Yet another object of this invention is to provide a wrist-worn lap and set counter for swimmers which readily tracks sets, laps and elapsed time per set.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
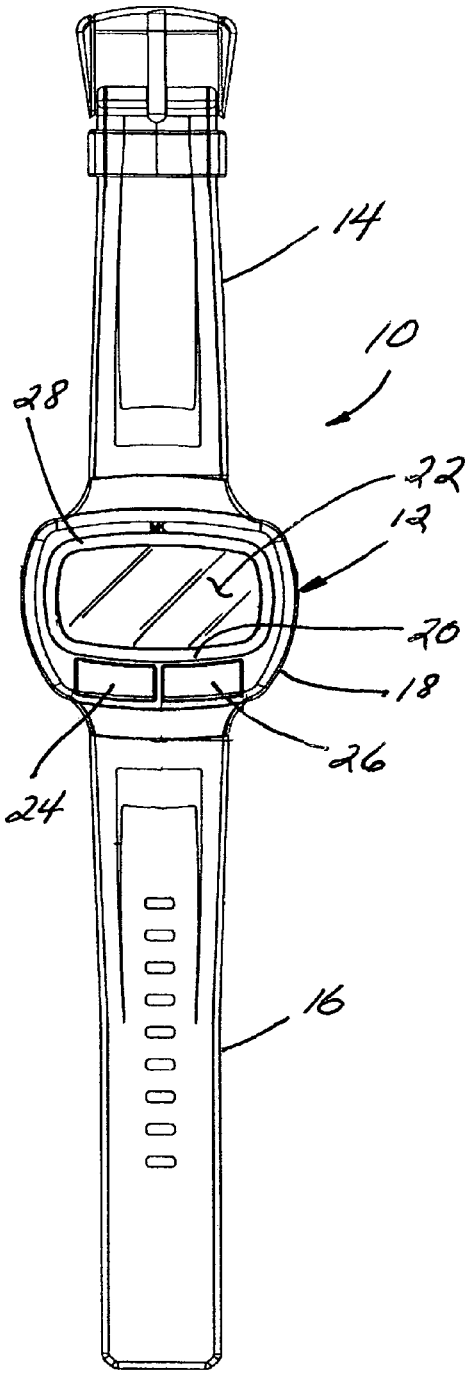
FIG. 1 is a plan view of the invention in outstretched orientation.
Figure 2:
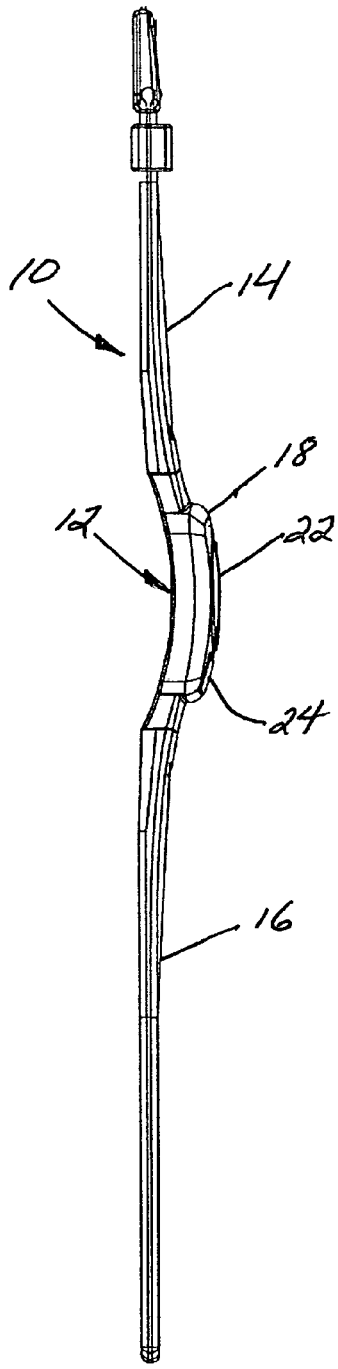
FIG. 2 is a side elevation view of FIG. 1.
Figure 3:
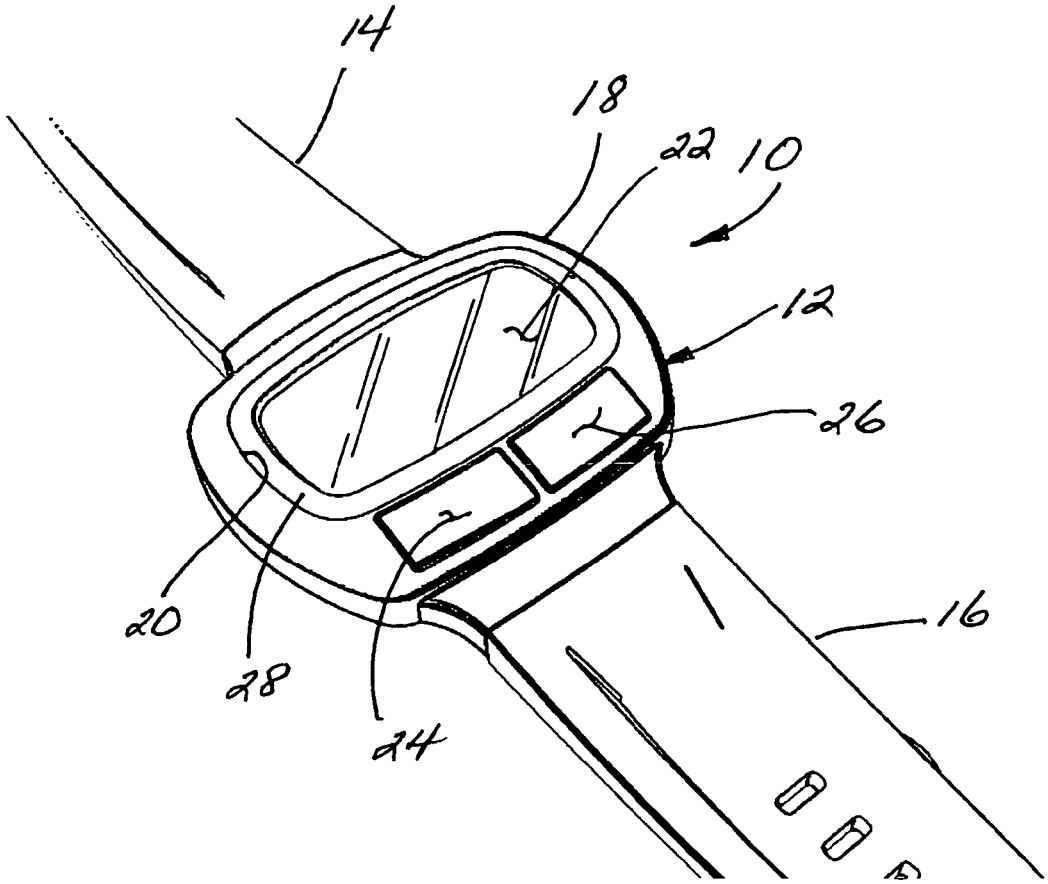
FIG. 3 is a perspective broken view of FIG. 1.

Referring now to the drawings, the invention is shown generally at numeral 10 in FIGS. 1 to 3 and includes an electronic lap counter/timer module 12 operably connected to conventional wristband segments 14 and 16 whereby a swimmer may attach the invention 10 around either right or left wrist during lap swimming activities. The exterior of the module includes a transparent lens or crystal 22 held within a bezel 28 which is mounted in watertight fashion within a bezel seat 20. First and second control or input buttons 24 and 26 regulate the operation of the module 12 as described herebelow.

Figure 4:
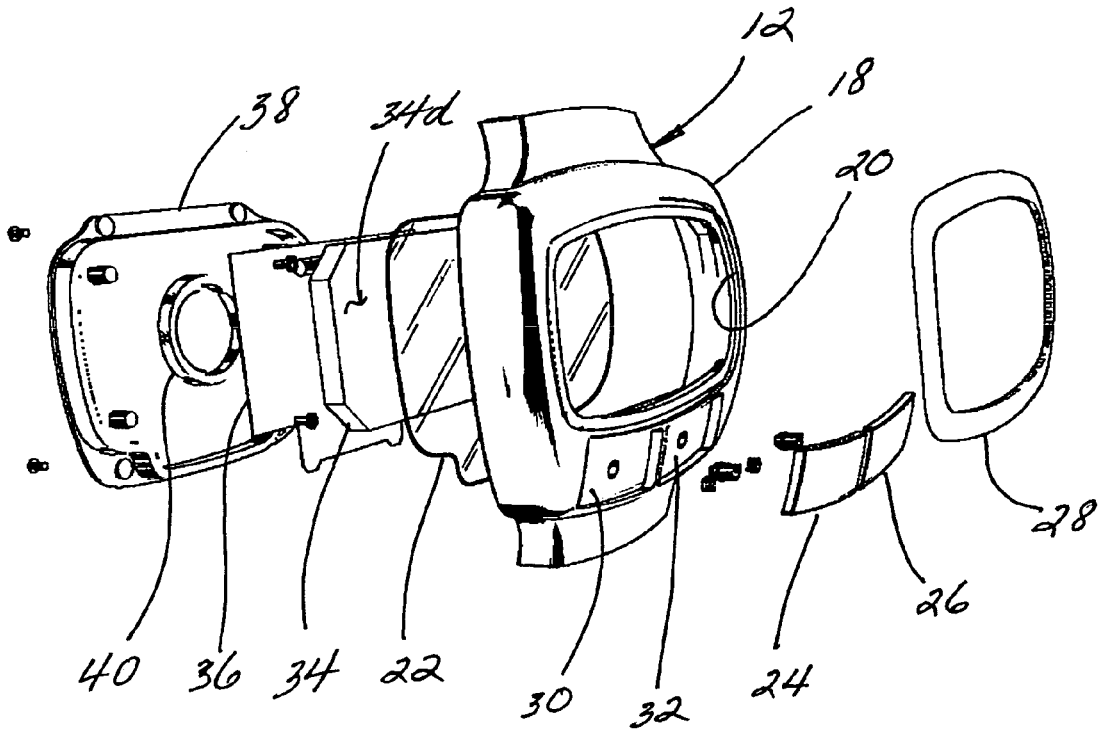
FIG. 4 is an exploded view of the lap counter/timer module of the invention.
Figure 5:
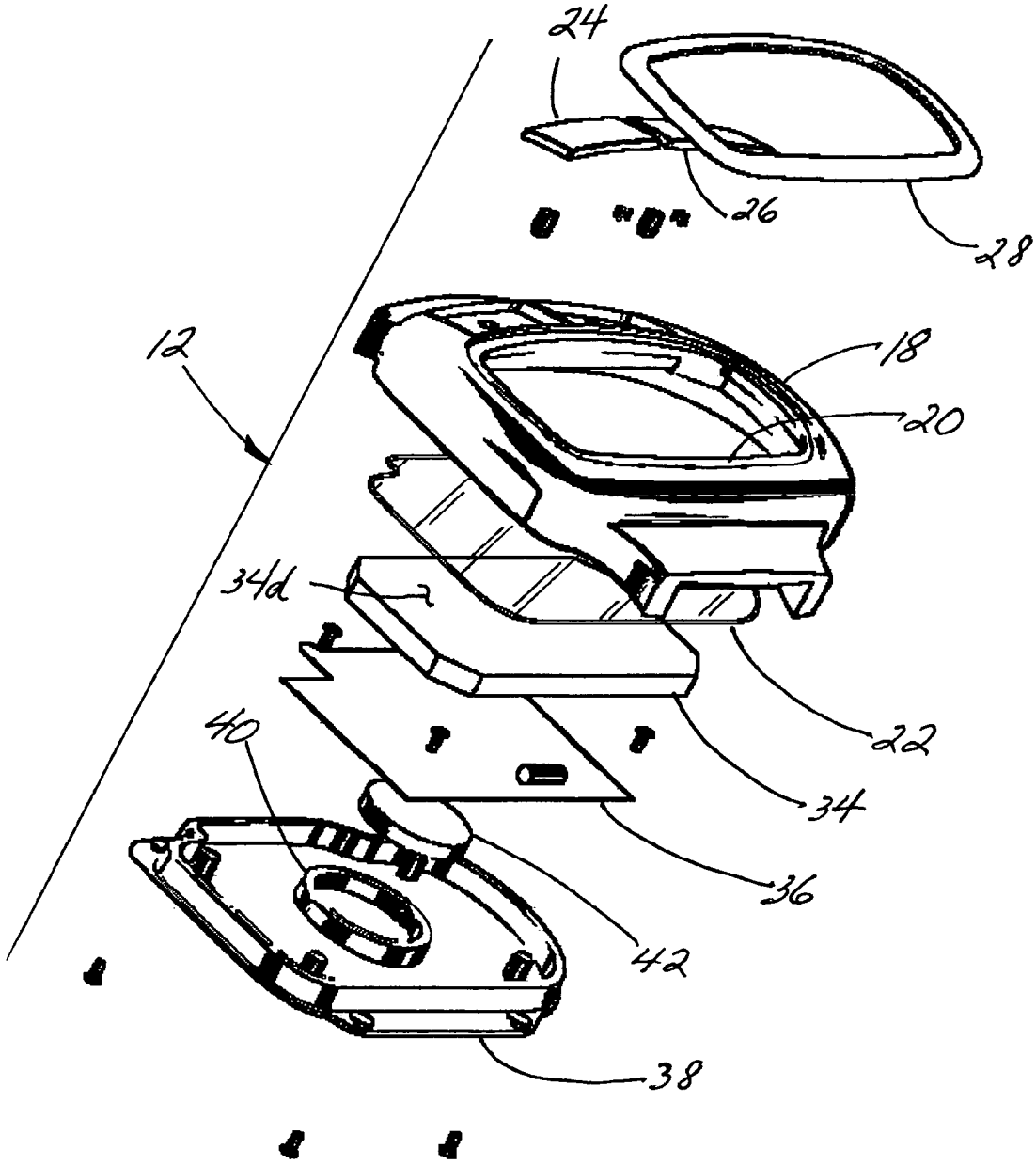
FIG. 5 is another exploded view similar to FIG. 4.

Referring particularly to FIGS. 4 and 5, the module 12 includes a machined or molded metal or plastic housing 18 which includes touch control button cavities 30 and 32 which support and assist in retaining the input buttons 24 and 26, respectively, in place by small springs and retaining screws shown therebetween.

An integrated circuit (IC) counter/timer 34 is positioned behind the lens 22 and includes a digital display 34*d* viewable from the front of the module 12 through the lens 22. A contact separator 36 is positioned against the IC counter/timer 34 and against and in electrical contact with a miniature battery 42 positioned within a battery cavity 40 formed centrally on the inner surface of a back cover 38.

Figure 6:
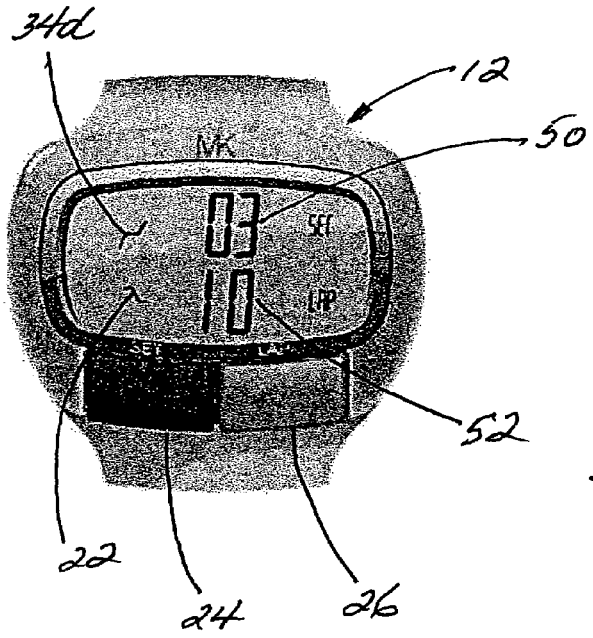
FIG. 6 is a plan view of the digital display of the invention showing the current set and lap indicating numbers.
Figure 7:
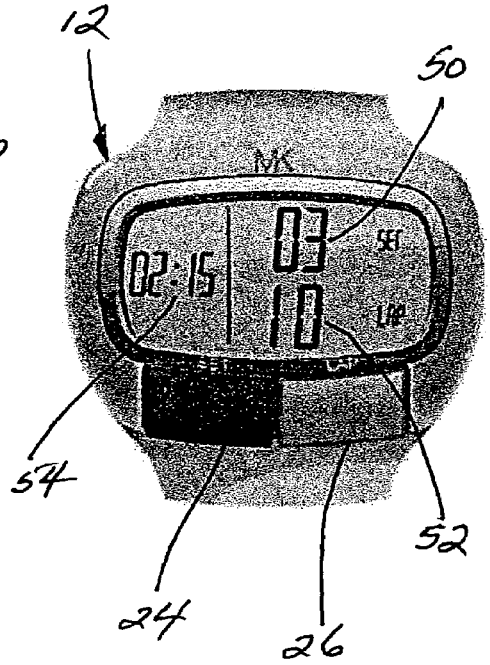
FIG. 7 is a plan view of FIG. 6 also showing the current lap elapsed time number.

Referring now to FIGS. 6 and 7, the viewable display 34*d* of the IC counter/timer 34 includes three digital display numbers, 50, 52 and 54. The lap set number 50, shown by example to be "03", displays the number of sets of laps which have been completed by the swimmer. The lap indicating number 52, shown by example to be "10", displays the total number of laps completed within the current set shown at 50. The current lap elapsed time number 54 shows the elapsed time of the current set in progress by the swimmer, shown by example "2:15 minutes".

Mode of Operation

Still referring to FIGS. 6 and 7, the mode of operation begins by the swimmer touching or pressing the first input button 24 or the second input button 26, either of which will activate the IC counter/timer 34. At this point, only the lap set number 50 and the lap indicating number 52 will be displayed similar to that shown in FIG. 6 except that the numerals 50 and 52 will read "00". Alternately, the lap elapsed time number 54 will either be unshown or, preferably "00".

The timer for the first set is commenced by pressing the first input button 24 at which point the lap set number 50 will read "01". The current set elapsed time number 54 will reflect that the internal timer of the IC counter/timer 34 has commenced. Further, the lap set number 52 will remain at "00".

At the end of the first lap, the swimmer will press the second input button 26 at which point the lap indicating number 52 will incrementally increase to "01". Completion of successive laps will increase the lap indicating number 52 incrementally by one as the swimmer depresses the second input button 26 at the end of each successive lap.

At the end of each set of laps, the swimmer will press and hold the second input button 26 for at least three seconds to reset the lap indicating number 52 to zero. Thereafter, the first input button 24 may be pressed which then increases the lap set number 50 incrementally by one and simultaneously reset the set elapsed time number 54 to zero to restart the timer. To turn the module off, the swimmer must press and hold both input buttons 24 and 26 for a period of at least three seconds.

All of the above functions occur simultaneously in the sequence above described once either of the input buttons 24 or 26 to initially activate the IC counter/timer 34 within the module 12. Only by depressing and holding both of the input buttons 24 and 26 for preferably at least three seconds does the unit power down and turn all of the display off.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A wrist worn lap counter for a swimmer comprising:

an electronic lap counter/timer module including:

a water resistant housing having a viewable front face and including a transparent lens covering a digital display, said digital display being operable to simultaneously display a lap set number, lap indicating number, and a current set elapsed time number;

first and second input buttons positioned on said housing;

said first or second input button, when pressed a first time, being operable to activate said module;

said first input button being operable to increase the lap set number by one and to simultaneously start the elapsed time number at zero;

said second input button being operable to increase by one the lap indicating number at the end of each lap;

said second input button, when pressed and held, being operable to zero the lap indicating number;

said first and second input buttons, when simultaneously pressed and held, being operable to deactivate said module;

a wrist strap connected to said module for attachment around the wrist of a swimmer.

2. A method of swimming lap and set counting comprising the steps of:

(a) providing a wrist strap supported electronic lap counter/timer module worn by a swimmer, said module including:

a water resistant housing having a viewable front face and including a transparent lens covering a digital display, said digital display being operable to simultaneously display a lap set number, lap indicating number, and a current set elapsed time number; and first and second input buttons positioned on said housing;

(b) pressing said first or second input button a first time to activate said module;

(c) pressing said first input button to increment the lap set number by one (1) and to simultaneously zero and start the elapsed time number;

(d) pressing said second input button at the end of each lap to increase by one the lap indicating number;

(e) pressing and holding said second input button at the end of each set to zero the lap indicating number;

(f) pressing and holding said first and second input buttons simultaneously to deactivate said module.

3. A lap counter for a swimmer comprising:

an electronic lap counter/timer module including:

a water resistant housing having a viewable front face and including a transparent lens covering a digital display, said digital display being operable to simultaneously display a lap set number, lap indicating number, and a current set elapsed time number;

first and second input buttons positioned on said housing;

said first or second input button being operable to activate said module to increase the lap set number by one and simultaneously start the elapsed time number at zero, increase by one the lap indicating number, zero the lap indicating number, and deactivate said module.

4. A lap counter for a swimmer comprising:

an electronic lap counter/timer module including:

a water resistant housing having a viewable front face and including a transparent lens covering a digital display, said digital display being operable to display a lap set number, lap indicating number, and a current set elapsed time number;

first and second input buttons positioned on said housing;

said first input button being operable to increase the lap set number by one and to start the elapsed time number at zero;

said second input button being operable to increase by one the lap indicating number and also to zero the lap indicating number.

* * * * *